US005484313A

United States Patent [19]

Rachal et al.

[11] Patent Number: 5,484,313

[45] Date of Patent: Jan. 16, 1996

[54] RESCUE NET

[76] Inventors: Don P. Rachal; Shirley J. Rachal, both of 2511 Woodland Rd., Mobile, Ala. 36693

[21] Appl. No.: 375,588

[22] Filed: Jan. 19, 1995

[51] Int. Cl.[6] ..... B63C 9/00

[52] U.S. Cl. ..... 441/80

[58] Field of Search ..... 441/80, 81, 82, 441/83, 84, 88

[56] References Cited

U.S. PATENT DOCUMENTS

| | | | |
|---|---|---|---|
| 4,129,905 | 12/1978 | Niemirow | 4/172.13 |
| 4,204,710 | 5/1980 | Rothaemel et al. | 294/77 |
| 4,398,760 | 8/1983 | Kirk | 294/77 |
| 4,652,246 | 3/1987 | Thorgeirsson | 441/80 |
| 5,158,489 | 10/1992 | Araki et al. | 441/80 |
| 5,320,566 | 6/1994 | Low | 441/80 |

FOREIGN PATENT DOCUMENTS

| | | | |
|---|---|---|---|
| 3809264 | 9/1989 | Germany | 441/80 |
| 255196 | 10/1988 | Japan | 441/80 |

*Primary Examiner*—Stephen Avila

[57] ABSTRACT

A rescue net for providing a means of capturing a human victim immersed in rushing water such as that found in a rapidly flowing river or flash flood area comprising a net having a rectangular border with four corners and a mesh portion extended across and coupled to the border; four rigid metal oval openable carabiners with each carabiner removably secured to a separate corner of the net; four pieces of rope with each piece of rope having a proximal end fastened to a separate carabiner and a distal end holdable by a user for allowing the net to be placed in an extended configuration; and a plurality of battery-powered water-proof strobe lights removably secured to the net.

2 Claims, 5 Drawing Sheets

FIG 7
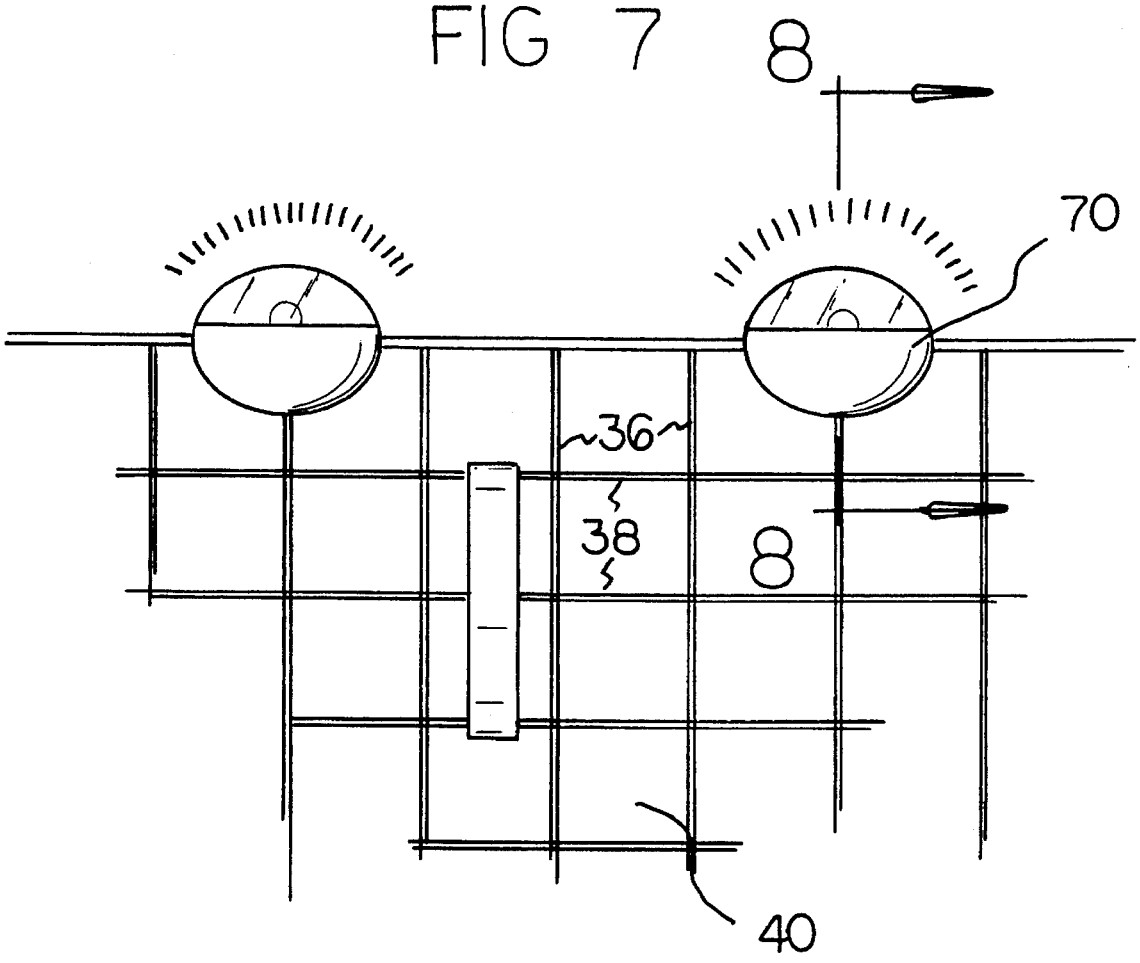
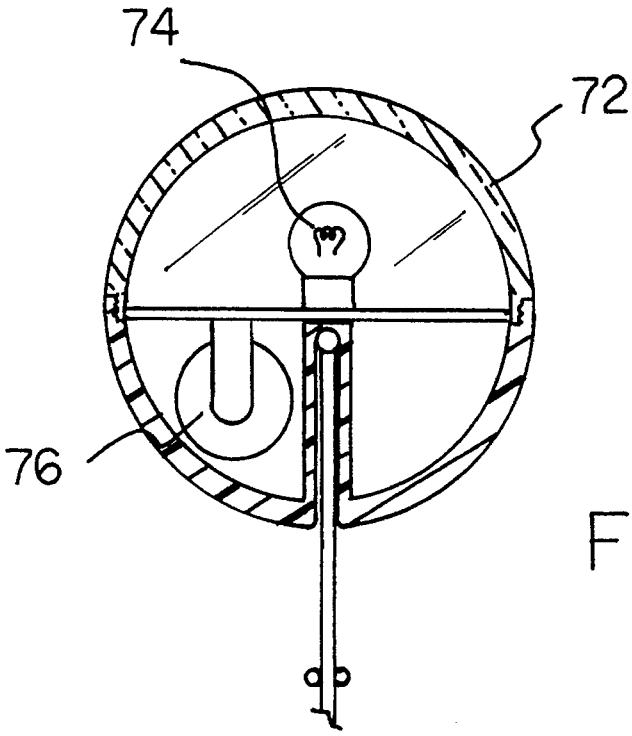
FIG 8

RESCUE NET

BACKGROUND OF THE INVENTION

1. Field of the Invention

The present invention relates to a rescue net and more particularly pertains to providing a way of capturing a human victim immersed in rushing water such as that found in a rapidly flowing river or flash flood area with a rescue net.

2. Description of the Prior Art

The use of rescue nets is known in the prior art. More specifically, rescue nets heretofore devised and utilized for the purpose of rescuing people from flowing water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,129,905 to Niemirow discloses a swimming pool rescue net. U.S. Pat. No. 4,204,710 to Rothaemel et al. discloses a rescue net. U.S. Pat. No. 4,398,760 to Kirk discloses a submersible net for helicopter rescue missions. U.S. Pat. No. 4,652,246 to Thorgeirsson, deceased, et al. discloses a life-net to rescue men from sea or water on board a ship or upon a pier. U.S. Pat. No. 5,158,489 to Araki et al. discloses a marine rescue life net.

While these devices fulfill their respective, particular objective and requirements, the aforementioned patents do not describe a rescue net that has handles secured thereto for allowing a human victim a firm grip when captured and has strobe lights removably secured thereto for allowing the net to be used under conditions of limited visibility.

In this respect, the rescue net according to the present invention substantially departs from the conventional concepts and designs of the prior art, and in doing so provides an apparatus primarily developed for the purpose of providing a way of capturing a human victim immersed in rushing water such as that found in a rapidly flowing river or flash flood area.

Therefore, it can be appreciated that there exists a continuing need for new and improved rescue net which can be used for providing a way of capturing a human victim immersed in rushing water such as that found in a rapidly flowing river or flash flood area. In this regard, the present invention substantially fulfills this need.

SUMMARY OF THE INVENTION

In the view of the foregoing disadvantages inherent in the known types of rescue nets now present in the prior art, the present invention provides an improved rescue net. As such, the general purpose of the present invention, which will be described subsequently in greater detail, is to provide a new and improved rescue net and method which has all the advantages of the prior art and none of the disadvantages.

To attain this, the present invention essentially comprises, in combination, a net formed of a flexible foldable nylon material coated with polypropylene. The nylon material has a tensile strength of between about 6,000 to 9,000 pounds. The net has a rectangular border formed of a top edge, a bottom edge, two opposed side edges extended between the top edge and bottom edge to create four corners, an eyelet coupled within each corner, and a grommet secured within each eyelet. The border of the net has a length of about 50 feet and a width of about 10 feet. The net further has a mesh portion extended across and coupled to the border. The mesh portion is formed of a first set of parallel spaced flat straps extended perpendicularly between and coupled to the top and bottom edges of the border and a second set of spaced parallel flat straps extended perpendicularly between and coupled to the side edges of the border and also coupled to the first set of straps and with the first set and second set of straps in combination defining a matrix of rectangular through holes. The net additionally includes a plurality of hand straps secured to the mesh portion for allowing a human victim a firm grip when captured.

Also provided are four rigid metal oval openable carabiners. Each carabiner is removably secured to a separate grommet of the net. Four pieces of rope are included with each piece having a proximal end fastened to a separate carabiner and a distal end holdable by a user for allowing the net to be placed in an extended configuration. A plurality of battery-powered water-proof strobe lights are included and removably secured to the top edge of the net for illuminating an area near the net and providing a visual indication to a human victim of the net's presence. A carrying bag is included for carrying the net, carabiners, pieces of rope, and strobe lights. The carrying bag is formed of a nylon material coated with polypropylene. The carrying bag has a bottom portion with a side portion integral with and extended upwards from the bottom portion to define a hollow interior and a central opening for allowing access to the interior. The carrying bag further has a draw-string closure coupled about the central opening and a grommet secured to the bottom portion. The carrying bag additionally includes a handle coupled thereto and a pair of shoulder straps coupled thereto for allowing its ready transport. The net, carabiners, pieces of rope, and strobe lights in combination weigh no more than 30 pounds.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rescue net which has all the advantages of the prior art rescue nets and none of the disadvantages.

It is another object of the present invention to provide a new and improved rescue net which may be easily and efficiently manufactured and marketed.

It is a further object of the present invention to provide a new and improved rescue net which is of durable and reliable construction.

An even further object of the present invention is to provide a new and improved rescue net which is susceptible of a low cost of manufacture with regard to both materials and labor, and which accordingly is then susceptible of low prices of sale to the consuming public, thereby making such a rescue net economically available to the buying public.

Still yet another object of the present invention is to provide a new and improved rescue net which provides in the apparatuses and methods of the prior art some of the advantages thereof, while simultaneously overcoming some of the disadvantages normally associated therewith.

Even still another object of the present invention is to provide a new and improved rescue net for providing a way of capturing a human victim immersed in rushing water such as that found in a rapidly flowing river or flash flood area.

Lastly, it is an object of the present invention to provide a new and improved rescue net comprising a net having a rectangular border with four corners and a mesh portion extended across and coupled to the border; four rigid metal oval openable carabiners with each carabiner removably secured to a separate corner of the net; four pieces of rope with each piece of rope having a proximal end fastened to a separate carabiner and a distal end holdable by a user for allowing the net to be placed in an extended configuration; and a plurality of battery-powered water-proof strobe lights removably secured to the net.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an enlarged fragmentary view of the top edge of the net with several strobe lights secured thereto.

FIG. 8 is a cross-sectional view of one of the strobe lights of the present invention taken along the line 8—8 of FIG. 7.

The same reference numerals refer to the same parts through the various Figures.

DESCRIPTION OF THE PREFERRED EMBODIMENT

Figure 1:
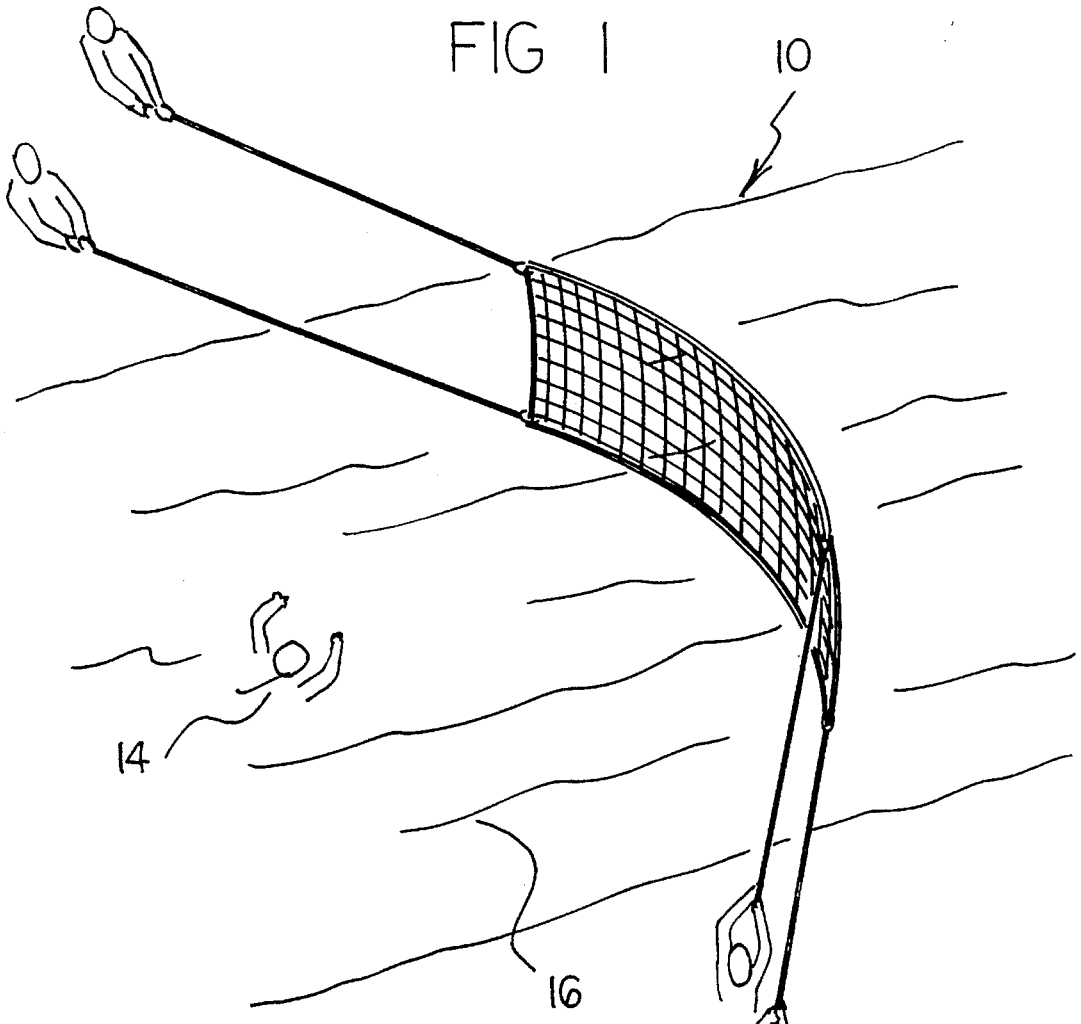
FIG. 1 is a perspective view of the preferred embodiment constructed in accordance with the principles of the present invention held in an extended configuration by rescuing personnel across a rapidly flowing river for capturing a human victim immersed therein.

With reference now to the drawings, and in particular, to FIG. 1 thereof, the preferred embodiment of the new and improved rescue net embodying the principles and concepts of the present invention and generally designated by the reference number 10 will be described.

The present invention is comprised of a plurality of components. In their broadest context, such components include a net, carabiners, rope, strobe lights, and a carrying bag. Such components are individually configured and correlated with respect to each other to perform the intended function of allowing rescuing personnel 12 to capture a human victim 14 immersed in rushing water 16 such as that found in a rapidly flowing river or a flash flood area.

Figure 2:
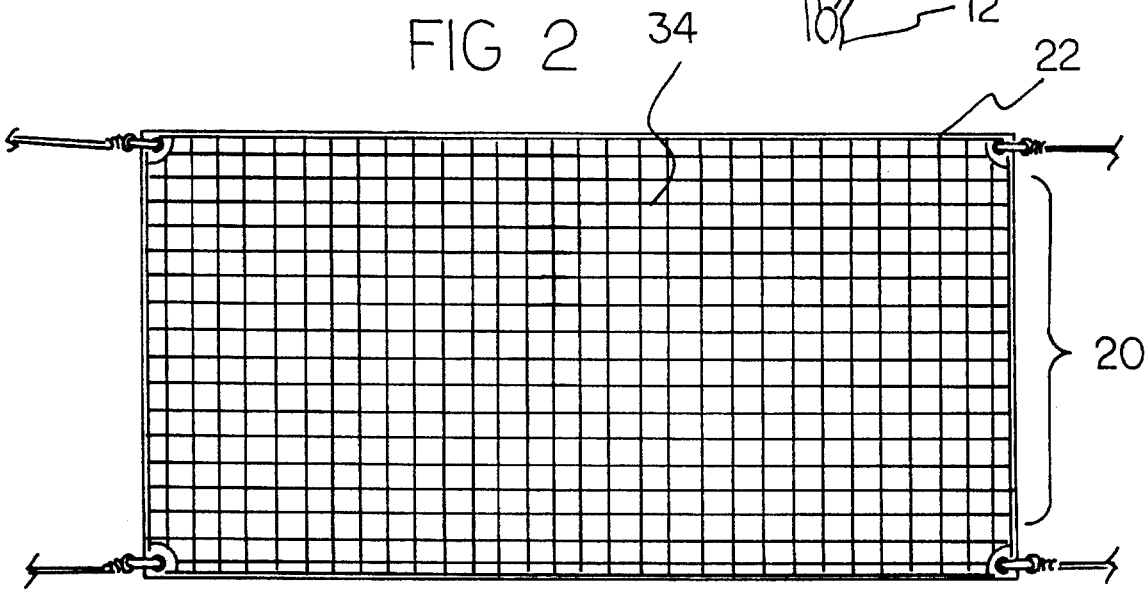
FIG. 2 is a plan view of the preferred embodiment in an extended configuration.

Specifically, the present invention includes a net 20 as shown in FIG. 2. The net is formed of a flexible and foldable nylon material. Preferably, the nylon material is of a bright color such as yellow for allowing it to be readily visible when extended across rushing water 16. The nylon material is also coated with a water-proof material such as polypropylene to preclude the net from becoming saturated with water and thereby increasing its weight. The nylon material used has a tensile strength of between about 6,000 to 9,000 pounds for setting an upper extent on the weight of a human victim as well as the weight placed thereon by rushing water 16 itself.

Figure 3:
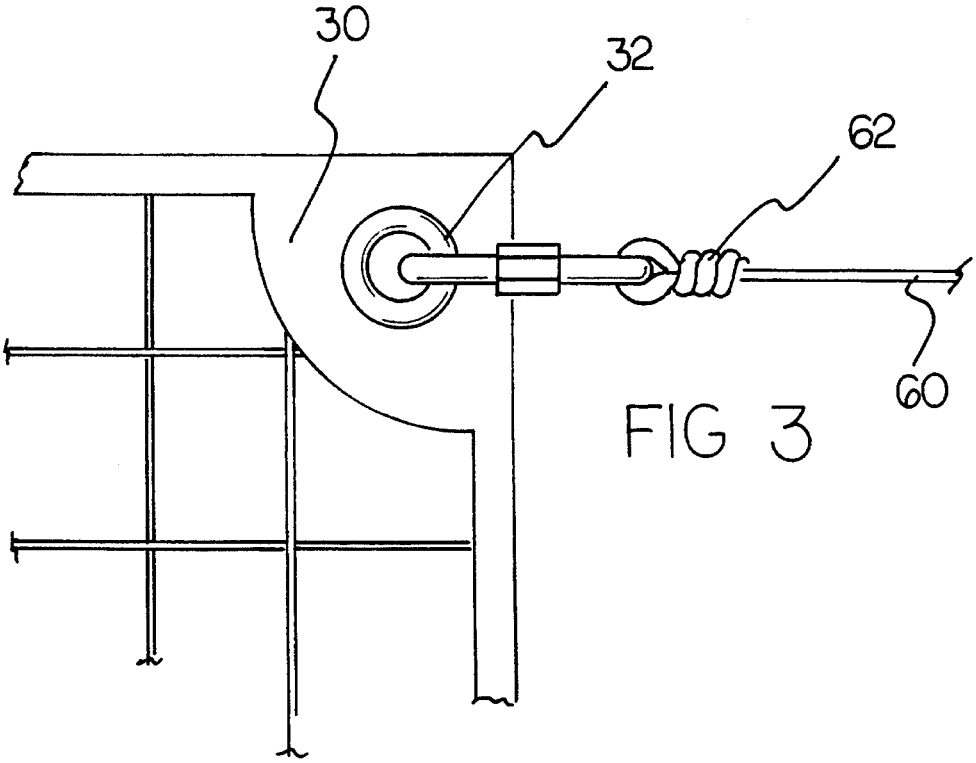
FIG. 3 is an enlarged fragmentary view of an upper corner of the net of the present invention.

The net has a rectangular border 22. The border is formed of a top edge 24, a bottom edge 26, and two opposed side edges 28 extended between the top edge and the bottom edge to create four corners. Each corner of the border has an eyelet 30 coupled thereto as best illustrated in FIG. 3. Furthermore, a plastic or metal grommet 32 is secured within each eyelet for increasing the holding strength of the eyelet. The border has a length of about 50 feet and a width of about 10 feet. However, the length and width of the present invention may be adjusted in accordance with operational conditions and intended use.

The net further has a mesh portion 34 extended across and coupled to the border as shown in FIG. 2. The mesh portion is formed of a first set of parallel, spaced, and flat straps 36. The first set of straps are extended perpendicularly between and sewn to the top and the bottom edges of the border as illustrated in FIG. 7. Furthermore, the mesh portion includes a second set of spaced, parallel, and flat straps 38. The second set of straps are extended perpendicularly between and sewn to the side edges of the border and are also sewn to the first set of straps. The first set of straps and the second set of straps in combination define a matrix of rectangular through holes 40. Each through hole is sized to preclude a human victim from passing through but to generally allow the flow of rushing water to pass unimpeded.

Figure 5:
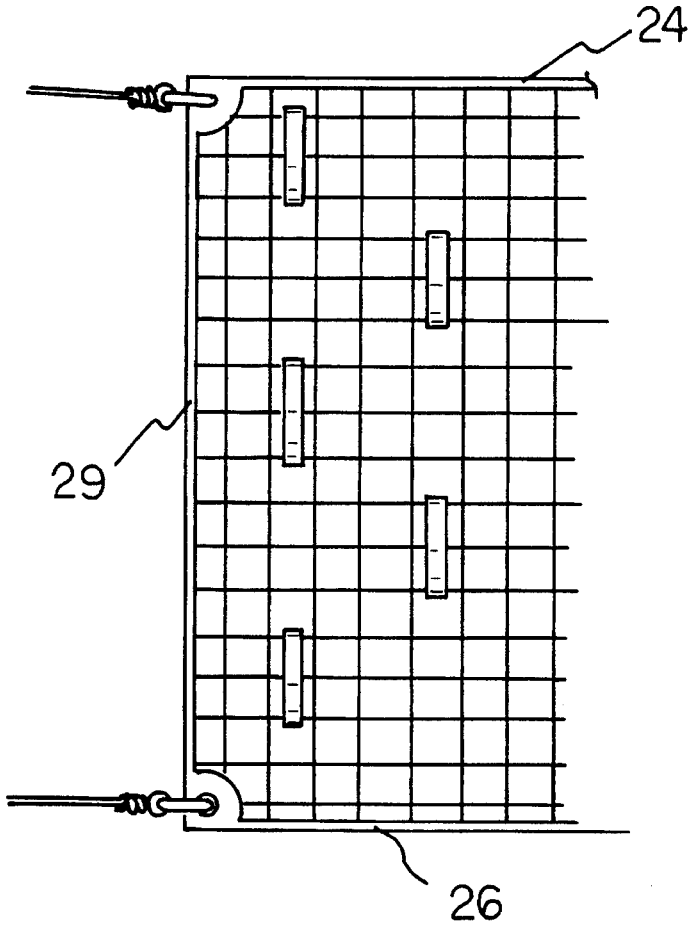
FIG. 5 is an enlarged fragmentary view of one side of the net with hand straps secured thereto.
Figure 6:
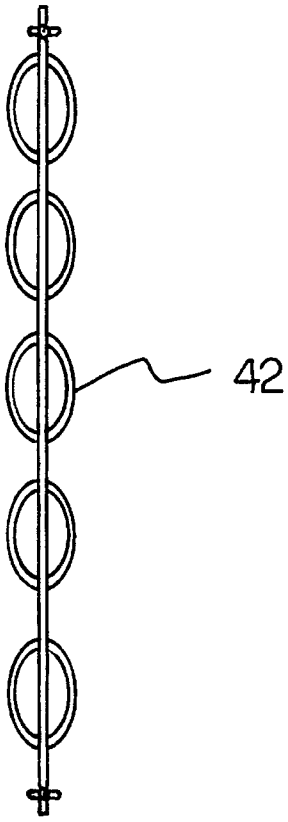
FIG. 6 is a side-elevational view of the net of the present invention.
Figure 9:
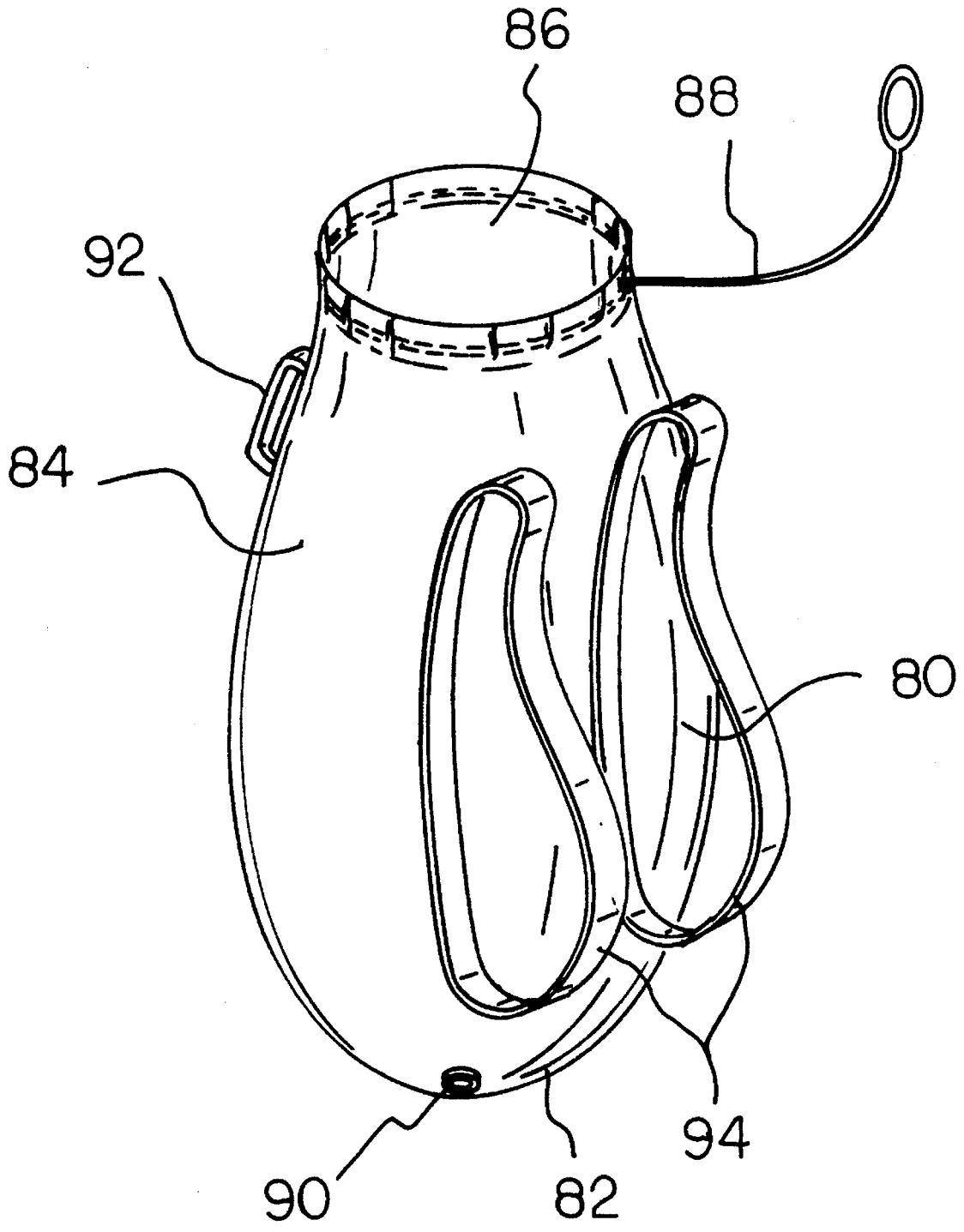
FIG. 9 is a view of the carrying bag of the present invention for allowing ready transport of the present invention from one location to another.

The net additionally includes a plurality of hand straps 42 sewn to the mesh portion at various locations as illustrated in FIG. 5. The hand straps allow a human victim a firm grip when captured. The hand straps are extended outwards from either side of the net to thereby make their use position dependent when the net is extended across a body of rushing water. The hand straps are also formed of a polypropylene-coated nylon material. The hand straps near the side edges of the net can be held by rescuing personal for extending the net in an operational mode for use.

Figure 4:
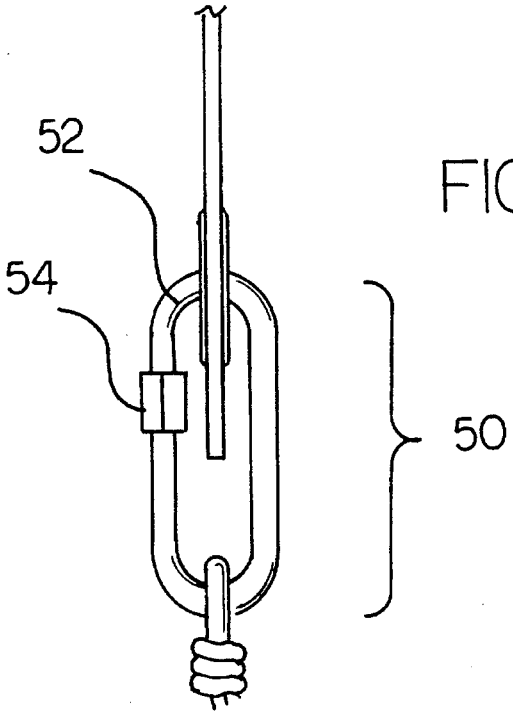
FIG. 4 is a fragmentary plan view of the securement of a carabiner to the net.

As shown in FIG. 4, four openable carabiners 50 are provided. Each carabiner is oval-shaped in structure and formed of a rigid material such as metal. Each carabiner has a generally C-shaped body 52 with a bolt secured to one end and threads formed on the other end. The bolt is removably secured to the threaded end. Each carabiner is removably secured to a separate grommet 52 of the net. Each carabiner is conventional in design and commercially available. Each carabiner also has a tensile strength greater than or equal to that of the nylon material of used to form the net.

Also provided are four pieces of rope 60 as shown in FIG. 3. Each piece of rope has a proximal end fastened to a separate carabiner with a knot 62. Each piece of rope also has a distal end holdable by a user for allowing the net to be placed in an extended configuration as shown in FIG. 1. Each piece of rope has a tensile strength greater than or equal to that of the nylon material used to form the net.

The present invention also includes a plurality of battery-powered strobe lights 70 as shown in FIG. 7. Each strobe light is removably secured to the top edge 24 of the net. The strobe lights illuminate an area near the net and provide a visual indication to a human victim of the net's presence in a low visibility condition. Each strobe light includes a water-proof housing 72 formed of an upper section and a lower section. An upwardly extended slot is formed on the lower section as shown in FIG. 8. The slot allows the strobe light to be removably secured to the top edge 24 of the net. Also included is a lamp 74 disposed within the housing, a "C" sized battery 76 for providing energy to the lamp, and a power switch coupled between the battery and lamp for allowing selective energization of the lamp as required.

To allow ready transport of the present invention from one location to another, a carrying bag 80 is also provided. The carrying bag is used for carrying the net, carabiners, pieces of rope, and strobe lights. The carrying bag is formed of a nylon material coated with a water-proof material such as polypropylene. The carrying bag has a bottom portion 82 with a side portion 84 integral with and extended upwards from the bottom portion to define a hollow interior and a central opening 86 for allowing access to the interior. The carrying bag also includes a draw-string closure 88 sewn about the central opening and a grommet 90 secured to the bottom portion. The grommet allows the carrying bag to be readily rigged and also provides a means for drainage when a wet net is disposed therein. The carrying bag additionally includes a handle 92 coupled thereto and a pair of shoulder straps 94 coupled thereto. The shoulder straps allow the carrying bag to be transported in an over-the-shoulder configuration for use in remote areas that are inaccessible by vehicles or other transportation means. Furthermore, the present invention is light-weight in design. The net, carabiners, pieces of rope, and strobe lights in combination weigh no more than 30 pounds. Thus, the present invention may be readily transported by a single rescuer.

The present invention is designed to serve as a quick and effective means of rescuing a human victim from rushing water such as that in a wide stream or rapidly flowing river or flash flood area. The present invention is comprised of a large portion of mesh material, four ropes and associated hardware. The netting section is made strong, but light-weight with material such as nylon. Four lengths of rope and four carabiners are also provided, and all of this equipment is stored in a carrying bag.

When required, the net, carabiners, rope, and strobe lights are removed from the bag for use. The four lengths of rope are attached to the upper and lower corners of the net using the carabiners. The strobe lights are also coupled to the top edge of the net if performing a night rescue or under conditions of limited visibility. Then, four rescuers, two stationed on each bank of a flooded area, immerse the netting into the water and pull on the ropes as shown in FIG. 1. This action will serve to extend the mesh portion of the net across the water in a vertically oriented attitude, and the current will propel the human victim immersed in the water into the netting. The rescued human victim can then insert his or her arms into the straps while being pulled from the water.

This entire procedure can be accomplished without the need of any rescuing personnel to enter the water and thereby endanger themselves. All of the equipment required is easily carried in one compact bag. The carrying bag also a carrying handles formed of 2 inch webbing secured thereto. Furthermore, the carrying bag has a set of shoulder straps coupled thereto for allowing ready transport of the bag in an over-the-shoulder configuration. The grommet at the end of the bag allows for ready and quick rigging and further serves a means for drainage. The net of the present invention is preferably yellow in color. The strobe lights are operable to provide directed illumination from 20 to 40 meters away from the net. Each strobe light is operable up to 20 hours on a single alkaline "C" cell battery. The strobe lights can also be provided with a pile-type fastener for allowing ready attachment to the netting. The present invention can be utilized with a boat, a car, or a helicopter as well as utilized in a man-to-man position on shore without the ropes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A rescue net for providing a way of capturing a human victim immersed in rushing water such as that found in a rapidly flowing river or flash flood area comprising, in combination:

a net formed of a flexible foldable nylon material coated with polypropylene and having a tensile strength of between about 6,000 to 9,000 pounds, the net having a rectangular border formed of a top edge, a bottom edge, two opposed side edges extended between the top edge and bottom edge to create four corners, an eyelet coupled within each corner, and a grommet secured within each eyelet and with the border having a length of about 50 feet and a width of about 10 feet, the net further having a mesh portion extended across and coupled to the border with the mesh portion formed of a first set of parallel spaced flat straps extended perpendicularly between and coupled to the top and bottom edges of the border and a second set of spaced parallel flat straps extended perpendicularly between and coupled to the side edges of the border and also coupled to the first set of straps and with the first set and second set of straps in combination defining a matrix of rectangular through holes, the net additionally including a plurality of hand straps secured to the mesh portion for allowing a human victim a firm grip when captured;

four rigid metal oval openable carabiners with each carabiner removably secured to a separate grommet of the net;

four pieces of rope with each piece having a proximal end fastened to a separate carabiner and a distal end holdable by a user for allowing the net to be placed in an extended configuration;

a plurality of battery-powered water-proof strobe lights removably secured to the top edge of the net for illuminating an area near the net and providing a visual indication to a human victim of the net's presence;

a carrying bag for carrying the net, carabiners, pieces of rope, and strobe lights, the carrying bag formed of a nylon material coated with polypropylene, the carrying bag having a bottom portion with a side portion integral with and extended upwards from the bottom portion to define a hollow interior and a central opening for allowing access to the interior, the carrying bag further having a draw-string closure coupled about the central opening and a grommet secured to the bottom portion, the carrying bag additionally including a handle coupled thereto and a pair of shoulder straps coupled thereto; and wherein the net, carabiners, pieces of rope, and strobe lights in combination weigh no more than 30 pounds.

2. A rescue net for providing a means of capturing a human victim immersed in rushing water such as that found in a rapidly flowing river or flash flood area comprising, in combination:

a net having a rectangular border with four corners and a mesh portion extended across and coupled to the border and wherein the net is formed of a flexible foldable fabric material having a tensile strength of between about 6,000 to 9,000 pounds with a coating of elastomeric water-proof material disposed thereover and wherein the net has a length of about 50 feet and a width of about 10 feet;

four rigid metal oval openable carabiners with each carabiner removably secured to a separate corner of the net;

four pieces of rope with each piece of rope having a proximal end fastened to a separate carabiner and a distal end holdable by a user for allowing the net to be placed in an extended configuration; and a plurality of battery-powered water-proof strobe lights removably secured to the net.

a plurality of hand straps secured to the mesh portion;

a closeable carrying for allowing ready transport of the net, carabiners, and pieces of rope and wherein the net, carabiners, pieces of rope, and strobe lights in combination weigh no more than 30 pounds.

* * * * *